US007768509B2

(12) United States Patent
Ichiyama

(10) Patent No.: US 7,768,509 B2
(45) Date of Patent: Aug. 3, 2010

(54) LIQUID CRYSTAL DISPLAY DEVICE AND DRIVING METHOD OF THE LIQUID CRYSTAL DISPLAY DEVICE

(75) Inventor: Iwane Ichiyama, Nomi (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 885 days.

(21) Appl. No.: 11/550,562

(22) Filed: Oct. 18, 2006

(65) Prior Publication Data

US 2007/0103415 A1 May 10, 2007

(30) Foreign Application Priority Data

Nov. 8, 2005 (JP) ..... 2005-323818

(51) Int. Cl.
*G09G 3/36* (2006.01)
*G09G 5/10* (2006.01)

(52) U.S. Cl. ..... 345/204; 345/87

(58) Field of Classification Search ..... 345/87–100, 345/204, 690–697
See application file for complete search history.

(56) References Cited

U.S. PATENT DOCUMENTS 6,952,194 B1 * 10/2005 Yamazaki et al. ..... 345/92
7,106,294 B2 * 9/2006 Kumamoto et al. ..... 345/102
2004/0189579 A1 * 9/2004 Shimizu ..... 345/98
2005/0156862 A1 * 7/2005 Hirayama et al. ..... 345/100

FOREIGN PATENT DOCUMENTS

JP 2001-356743 12/2001
JP 2004-219823 8/2004
KR 2001-0113486 12/2001

* cited by examiner

*Primary Examiner*—Amare Mengistu
*Assistant Examiner*—Sosina Abebe
(74) *Attorney, Agent, or Firm*—Oblon, Spivak, McClelland, Maier & Neustadt, L.L.P.

(57) ABSTRACT

A liquid crystal display device includes a plurality of source lines, a plurality of display pixels, each of which is connected to an associated one of the plurality of source lines, a source driver which successively outputs a non-video signal which is common to the plurality of source lines and a video signal which is independent in association with each of the plurality of source lines, a selection switch circuit which is connected between the plurality of source lines and the source driver, and a controller which controls the source driver and the selection switch circuit, wherein the controller is configured to control the selection switch circuit such that the non-video signal which is output from the source driver, is supplied to the plurality of source lines in parallel, and a timing of an end of supply of the non-video signal is varied between the plurality of source lines.

7 Claims, 5 Drawing Sheets

LIQUID CRYSTAL DISPLAY DEVICE AND DRIVING METHOD OF THE LIQUID CRYSTAL DISPLAY DEVICE

CROSS-REFERENCE TO RELATED APPLICATIONS

This application is based upon and claims the benefit of priority from prior Japanese Patent Application No. 2005-323818, filed Nov. 8, 2005, the entire contents of which are incorporated herein by reference.

BACKGROUND OF THE INVENTION

1. Field of the Invention

The present invention relates generally to a liquid crystal display device and a driving method thereof, and more particularly to a liquid crystal display device which is driven in an active matrix method, and a driving method thereof.

2. Description of the Related Art

In recent years, mobile products in which liquid crystal panels are built, such as small-sized game machines, portable PCs and mobile phones, have been quickly gaining in popularity.

In general, the liquid crystal display panel is configured such that a liquid crystal layer is held between an array substrate and a counter-substrate. In the case where the liquid crystal display panel is of an active matrix type, the array substrate includes a plurality of pixel electrodes which are arranged substantially in a matrix, a plurality of gate lines which are disposed along rows of the plural pixel electrodes, a plurality of source lines which are disposed along columns of the plural pixel electrodes, and a plurality of pixel switching elements which are disposed near intersections of the plural gate lines and plural source lines.

The respective gate lines are connected to a gate driver which drives the gate lines. The respective source lines are connected to a source driver which drives the source lines. The gate driver and source driver are controlled by a control circuit. Each of the pixel switching elements is composed of, e.g. a thin-film transistor (TFT). When the associated gate line is driven by the gate driver, the pixel switching element is rendered conductive, thereby applying a pixel voltage, which is set on the associated source line by the source driver, to the associated pixel electrode.

The counter-substrate is provided with a common electrode which is opposed to the plural pixel electrodes disposed on the array substrate. A liquid crystal pixel is constituted by a pair of each pixel electrode and the common electrode, together with a pixel region which is a part of the liquid crystal layer that is interposed between these paired electrodes. A driving voltage for the pixel is a difference between a pixel voltage, which is applied to the pixel electrode, and a common voltage which is applied to the common electrode. Even after the pixel switching element is turned off, the driving voltage is held between the pixel electrode and the common electrode.

Alignment of liquid crystal molecules in the pixel region is set by an electric field which corresponds to the driving voltage. Thereby, the transmittance of the pixel is controlled. The polarity reversal of the driving voltage is executed, for example, by cyclically reversing the polarity of the pixel voltage in relation to the common voltage. Thus, the direction of electric field is reversed to prevent non-uniform distribution of liquid crystal molecules in the liquid crystal layer.

In the field of large-sized liquid crystal TVs, liquid crystal display panels of an OCB (Optically Compensated Bend) mode, which has a high liquid crystal responsivity that is needed for motion video display, have begun to be adopted. This liquid crystal display panel performs a display operation by transitioning the alignment state of liquid crystal molecules from splay alignment to bend alignment in advance. In this case, if a voltage-off state or a nearly voltage-off state continues for a long time, the bend alignment reversely transitions to the splay alignment. In this type of liquid crystal display panel, black-insertion driving is used in order to prevent the reverse transition to the splay alignment.

On the other hand, in the prior art, there is proposed a liquid crystal display device which is configured such that a plurality of write periods are provided in one horizontal period and video signals are output to different source lines in these write periods in a distributed manner (see Jpn. Pat. Appln. KOKAI Publication No. 2004-219823).

When selective driving is performed, only a selected selection switch of a source line output is turned on, and a desired signal voltage is written on the associated source line. At this time, if black-insertion driving is to be further executed, a plurality of selection switches are simultaneously turned on to start write of a black-level signal voltage. Thereafter, the plural selection switches are simultaneously turned off to stop the write of the black-level signal voltage. In this case, there may arise such a problem that the load on the source driver varies before and after the turn-off of the selection switches and a voltage signal, which exceeds a rated voltage, may occur at a timing when the channels of the plural selection switches are simultaneously turned on/off.

BRIEF SUMMARY OF THE INVENTION

The present invention has been made in consideration of the above-described problem, and the object of the invention is to provide a liquid crystal display device which prevents a voltage signal, which exceeds a rated voltage, from occurring when a plurality of selection switches for selecting source lines are simultaneously turned off, and thus prevents an erroneous operation.

According to a first aspect of the present invention, there is provided a liquid crystal display device comprising: a plurality of source lines; a plurality of display pixels, each of which is connected to an associated one of the plurality of source lines; an output driver which successively outputs a non-video signal which is common to the plurality of source lines and a video signal which is independent in association with each of the plurality of source lines; a selection switch circuit which is connected between the plurality of source lines and the output driver; and a controller which controls the output driver and the selection switch circuit, wherein the controller is configured to control the selection switch circuit such that the non-video signal, which is output from the output driver, is supplied to the plurality of source lines in parallel, and a timing of an end of supply of the non-video signal is varied between the plurality of source lines.

According to a second aspect of the present invention, there is provided a driving method of a liquid crystal display device including a plurality of source lines; a plurality of display pixels, each of which is connected to an associated one of the plurality of source lines; an output driver which successively outputs a non-video signal which is common to the plurality of source lines and a video signal which is independent in association with each of the plurality of source lines; a selection switch circuit which is connected between the plurality of source lines and the output driver; and a controller which controls the output driver and the selection switch circuit, the driving method comprising: controlling the selection switch circuit by the controller such that the non-video signal, which is output from the output driver, is supplied to the plurality of source lines in parallel, and a timing of an end of supply of the non-video signal is varied between the plurality of source lines.

The present invention can provide a liquid crystal display device and a driving method thereof, wherein a selection switch circuit is controlled so as to vary the timing of the end of supply of a non-video signal between source lines, thereby preventing a voltage signal, which exceeds a rated voltage, from occurring when a plurality of selection switches for selecting source lines are simultaneously turned off, and thus preventing an erroneous operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A liquid crystal display device and a driving method thereof according to an embodiment of the present invention will now be described with reference to the accompanying drawings.

Figure 1:
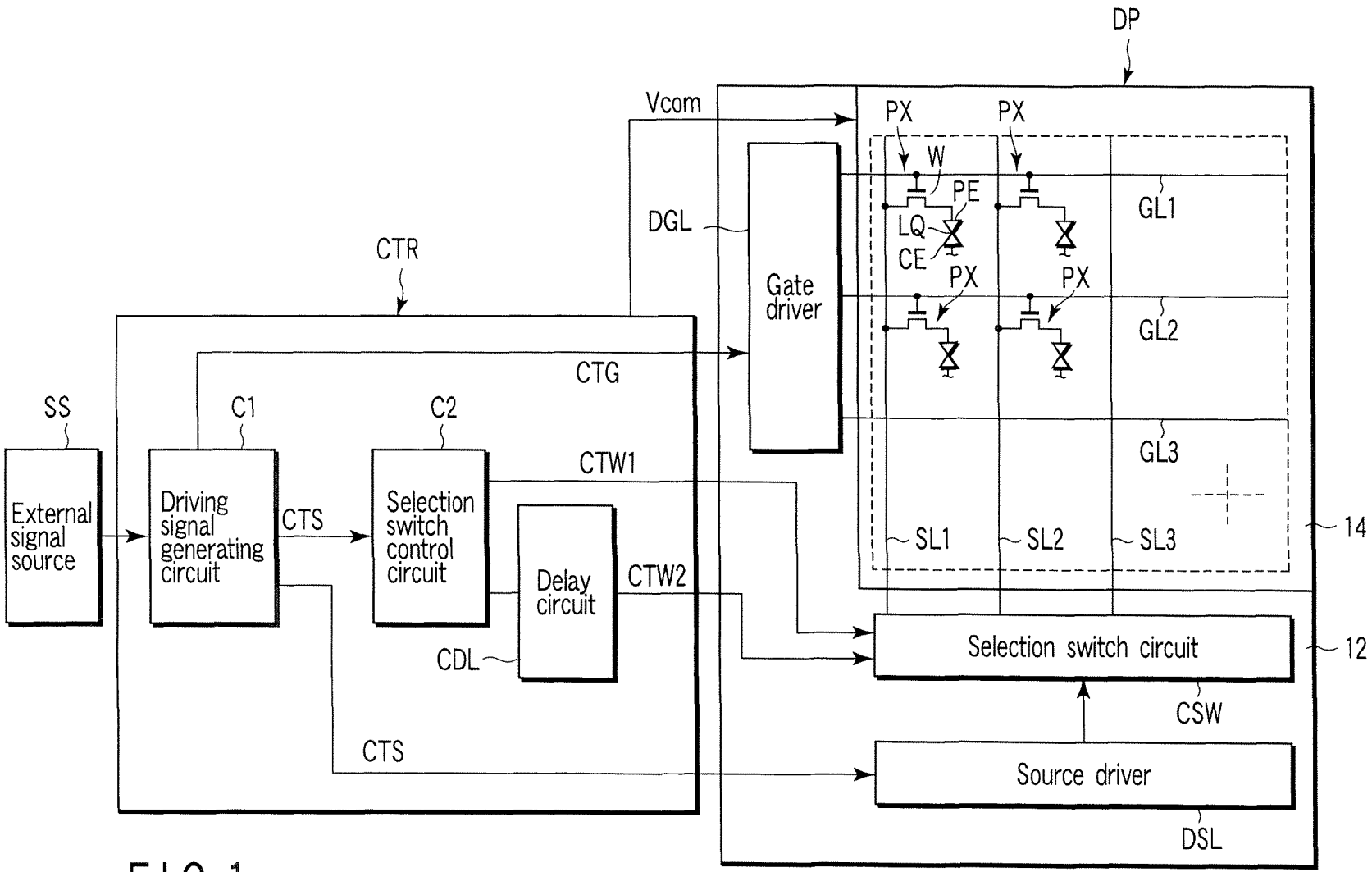
FIG. 1 schematically shows a liquid crystal display panel of a liquid crystal display device according to an embodiment of the present invention.

The liquid crystal display device according to the embodiment includes a liquid crystal display panel DP and a controller CTR, as shown in FIG. 1. The liquid crystal display panel DP includes an array substrate 12, a counter-substrate 14 and a liquid crystal layer LQ which is held between the array substrate 12 and counter-substrate 14. The liquid crystal layer LQ includes, as a liquid crystal material, a liquid crystal which is transitioned in advance from splay alignment to bend alignment, for example, in order to perform a normally white display operation.

Reverse transition from bend alignment to splay alignment is prevented by cyclically applying a non-video signal Vbk, which corresponds to black display, to the liquid crystal layer LQ. Specifically, the non-video signal Vbk has a voltage level for preventing reverse transition of liquid crystal molecules.

The array substrate 12 includes a plurality of pixel electrodes PE which are arranged substantially in a matrix on a transparent insulating substrate such as a glass substrate; a plurality of gate lines GL (GL1 to GLm) which are arranged along rows of the plural pixel electrodes PE; a plurality of source lines SL (SL1 to SLn) which are arranged along columns of the plural pixel electrodes PE; and a plurality of pixel switching elements W1 which are disposed near intersections of the gate lines GL and source lines SL and are rendered conductive between the associated source lines SL and associated pixel electrodes PE when the pixel switching elements W1 are driven via the associated gate lines GL.

Each of the pixel switching elements W1 is composed of, e.g. a thin-film transistor. The thin-film transistor has a gate connected to the gate line GL and a source-drain path connected between the source line SL and the pixel electrode PE.

The counter-substrate 14 includes a common electrode CE which is disposed to be opposed to the plural pixel electrodes PE. Each of the pixel electrodes PE and the common electrode CE is formed of a transparent electrode material such as ITO. The pixel electrodes PE and the common electrode CE are covered with alignment films (not shown) which are subjected to rubbing treatment in mutually parallel directions.

An OCB liquid crystal pixel PX is constituted by each of the pixel electrodes PE and the common electrode CE together with a pixel region which is a part of the liquid crystal layer LQ that is controlled to have an orientation of liquid crystal molecules corresponding to an electric field generated from the pixel electrode PE and common electrode CE.

The liquid crystal display panel DP further includes a gate driver DGL which is connected to the plural gate lines GL, a selection switch circuit CSW which is connected to the plural source lines SL, and a source driver DSL which is connected to the selection switch circuit CSW. The gate driver DGL successively drives the plural gate lines GL so as to turn on the plural switching elements W1 on a row-by-row basis.

Figure 2:
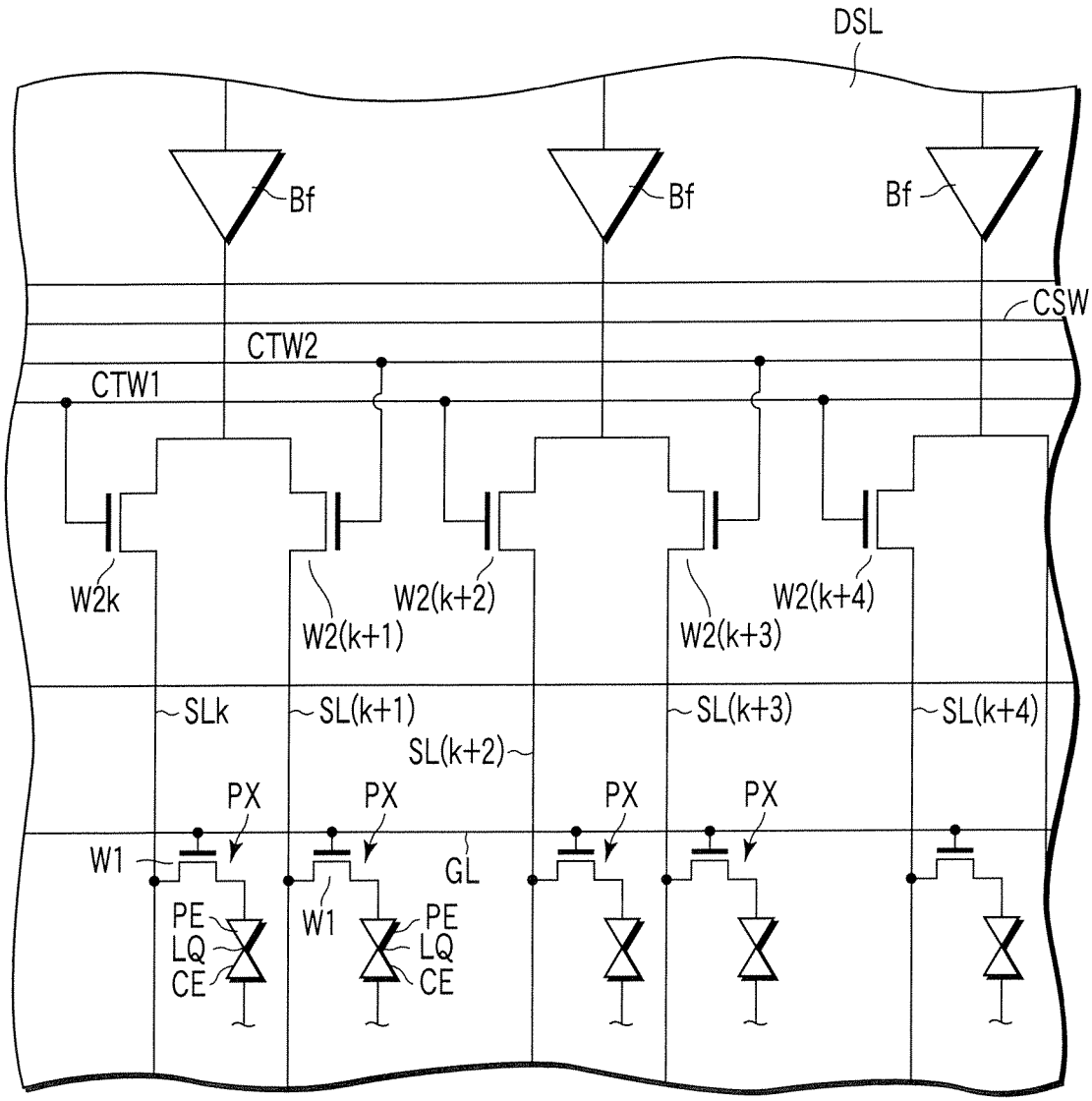
FIG. 2 illustrates, in detail, an example of the structure of a source driver and a selection switch circuit of the liquid crystal display panel shown in FIG. 1.

As shown in FIG. 2, the source driver DSL includes output buffers Bf. The source driver DSL successively outputs, from the output buffers Bf, a non-video signal Vbk which is common to the plural source lines SL and a video signal Vp which is independent in association with each of the source lines SL.

The selection switch circuit CSW includes a plurality of analog switches W2 (W21 to W2*n*), each of which is connected to the source driver DSL and an associated one of the source lines SL. In this embodiment, as shown in FIG. 2, an output line of each output buffer Bf of the source driver DSL is connected to two associated source lines SL via associated analog switches W2. The gate driver DGL, source driver DSL and selection switch circuit CSW are controlled by the controller CTR.

The controller CTR is configured to control the selection switch circuit CSW so that the non-video signal Vbk may be supplied from the source driver DSL to the plural source lines SL in parallel and the supply-end timing of the non-video signal Vbk may vary between the source lines SL.

Specifically, as shown in FIG. 1, the controller CTR includes a driving signal generating circuit C1, a selection switch control circuit C2 and a delay circuit CDL. On the basis of a timing signal and a video signal which are input from an external signal source SS, the driving signal generating circuit C1 outputs a horizontal sync signal CTG and a vertical sync signal CTS as driving signals.

The selection switch control circuit C2 receives the vertical sync signal CTS from the driving signal generating circuit C1 and outputs a first selection switch control signal CTW1, which controls the analog switches W2 of the selection switch circuit CSW, to the selection switch circuit CSW and the delay circuit CDL. The delay circuit CDL delays the first selection switch control signal CTW1 for the plural analog switches W2 so as to vary the supply timing of the non-video signal Vbk to the plural source lines SL. The delay circuit CDL outputs the delayed first selection switch control signal CTW1 as a second selection switch control signal CTW2

The above-described liquid crystal display device is configured such that the controller CTR, when power is turned on, varies a common voltage Vcom and supplies a relatively high driving voltage to the liquid crystal layer LQ, thereby executing an initializing process for transitioning liquid crystal molecules from splay alignment to bend alignment. In addition, the controller CTR outputs to the gate driver DGL a control signal CTG which is generated on the basis of a sync signal that is input from the external signal source SS, and outputs to the source driver DSL a control signal CTS, which is generated on the basis of the sync signal that is input from the external signal source SS, and a video signal or a non-video signal for black insertion which is input from the external signal source SS.

Figure 3:
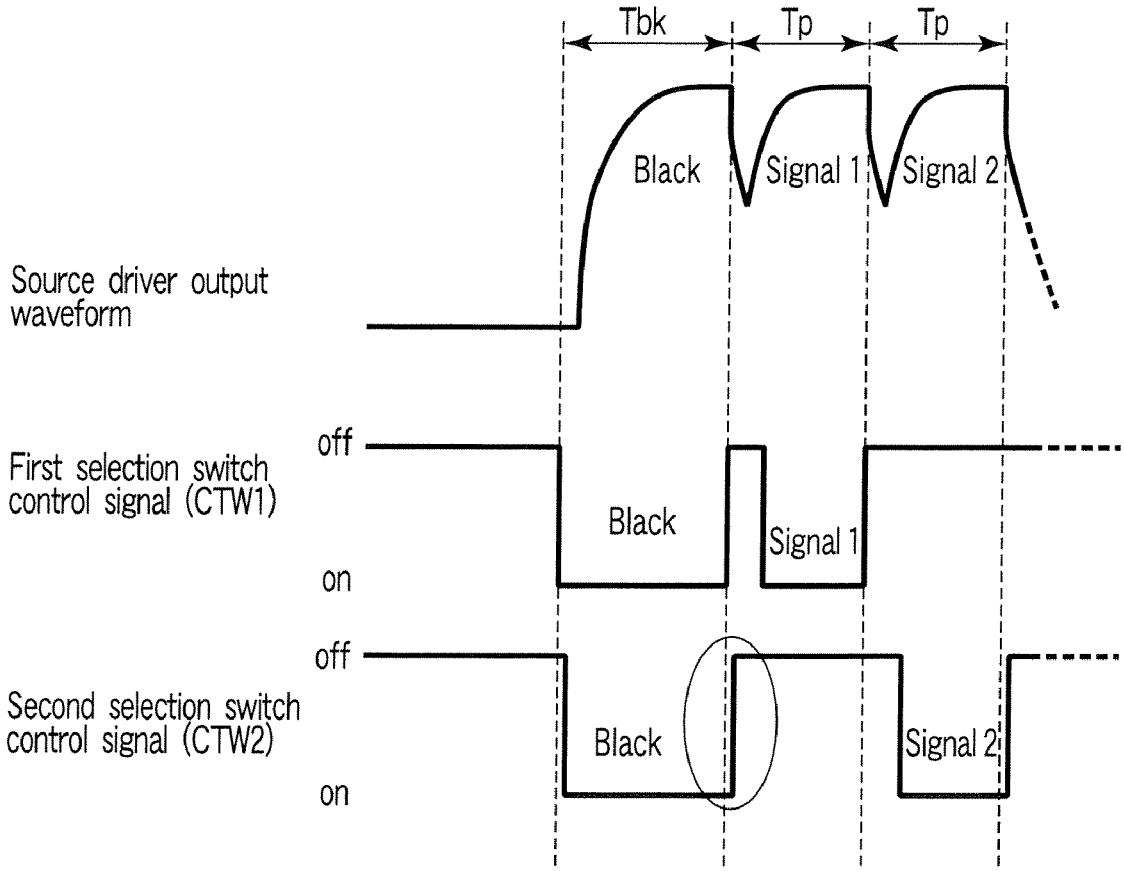
FIG. 3 is a timing chart illustrating an example of the operation of the selection switch circuit and source driver of the liquid crystal display device shown in FIG. 1.

Further, the controller CTR outputs the common voltage Vcom to the common electrode CE of the counter-substrate CT. In the driving signal generating circuit C1 of the controller CTR, a non-video signal write period Tbk and a plurality of video signal write periods Tp are set, as shown in FIG. 3, on the basis of the sync signal that is input from the external signal source SS. The length of the video signal write period Tp is different from that of the non-video signal write period Tbk.

The non-video signal write period Tbk is used for writing a black-level voltage signal as the non-video signal Vbk in the plural liquid crystal pixels PX. The video signal write period Tp is used for writing the video signals in the plural liquid crystal pixels PX.

The gate driver DGL successively drives, under the control of the control signal CTG, the plural gate lines GL so as to successively select, as black-insertion scan, the rows of the plural liquid crystal pixels PX in the non-video signal write period Tbk. In the video signal write period Tp following the non-video signal write period Tbk, the gate driver DGL successively drives the plural gate lines GL so as to successively select, as video signal write scan, the rows of the plural liquid crystal pixels PX.

On the other hand, in the non-video signal write period Tbk, the source driver DSL outputs the black-level pixel voltage as the non-video signal Vbk for one row while each of the plural gate lines GL is being driven. In the video signal write period Tp, the source driver DSL outputs video signals Vp for one associated row while each of the plural gate lines GL is being driven.

Output signals of the source driver DSL are delivered from the output buffers Bf and are input to the selection switch circuit CSW. The analog switches W2 of the selection switch circuit CSW are controlled by the first selection switch control signal CTW1 which is input from the selection switch control circuit C2 of the controller CTR, and the second selection switch control signal CTW2 which is input from the selection switch control circuit C2 via the delay circuit CDL.

In the present embodiment, analog switches W2 (W21, W23, . . . ), which are connected to odd-numbered source lines SL (SL1, SL3, . . . ), are controlled by the first selection switch control signal CTW1, and analog switches W2 (W22, W24, . . . ), which are connected to even-numbered source lines SL (SL2, SL4, . . . ), are controlled by the second selection switch control signal CTW2. At this time, the second selection switch control signal CTW2 is delayed by 0.4 μsec by the delay circuit CDL, relative to the first selection switch control signal CTW1.

For example, the analog switch W2*k* connected to the source line SLk (k=even number) and the analog switch W2(k+1) connected to the source line SL(k+1), as shown in FIG. 2, are controlled as shown in FIG. 3. Specifically, the analog switch W2*k* and analog switch W2(k+1) are turned on in the non-video signal write period Tbk, and the black-level voltage signal is applied as the non-video signal Vbk to the source lines SLk and SL(k+1).

At this time, the analog switch W2*k* and the analog switch W2(k+1) are controlled so that the timing of write of the non-video signal Vbk on the source line SLk may differ from the timing of write of the non-video signal Vbk on the source line SL(k+1). In the present embodiment, the analog switch W2(k+1) is controlled to be turned on/off with a delay from the analog switch W2*k*.

In a video signal write period Tp following the non-video signal write period Tbk, the analog switch W2*k* is turned on and a video signal Vp (signal 1) is applied to the source line SLk. Further, in a subsequent video signal write period Tp, the analog switch W2(k+1) is turned on and a video signal Vp (signal 2) is applied to the source line SL(k+1). The pixel voltages Vp for one row, which are successively applied to the plural source lines SL, are applied to the liquid crystal pixels PX of the selected row via the associated pixel switching elements W1. In the case of column-reversal driving, the video signals Vp for all the liquid crystal pixels PX are reversed in polarity on a pixel-row-by-pixel-row basis. In the case of frame-reversal driving, the video signals Vp for all the liquid crystal pixels PX are reversed in polarity on a frame-by-frame basis.

Figure 4A:
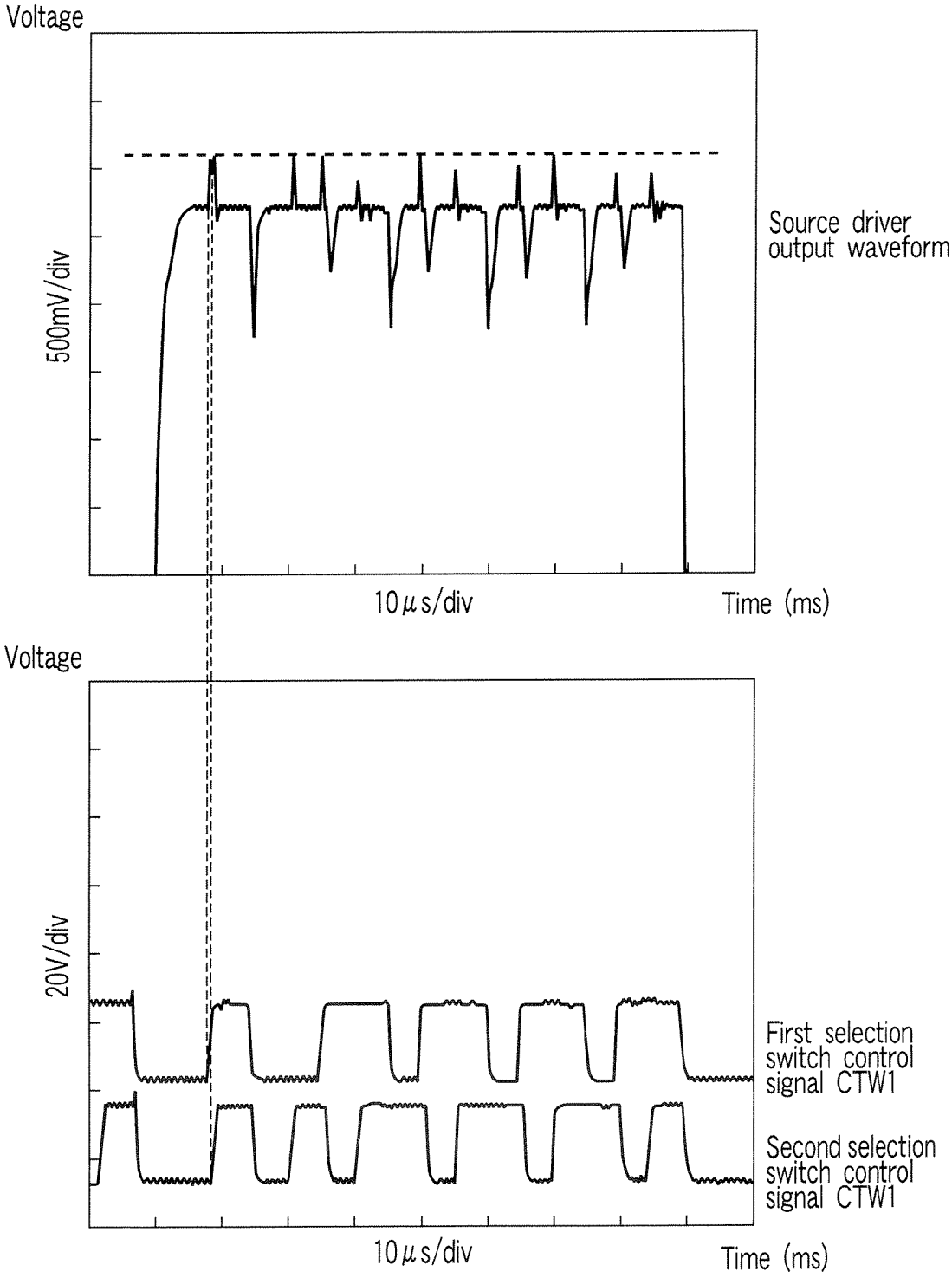
FIG. 4A shows examples of waveforms of an output signal of the source driver, a first selection switch control signal and a second selection switch signal at a time when the liquid crystal display device shown in FIG. 1 is driven.
Figure 4B:
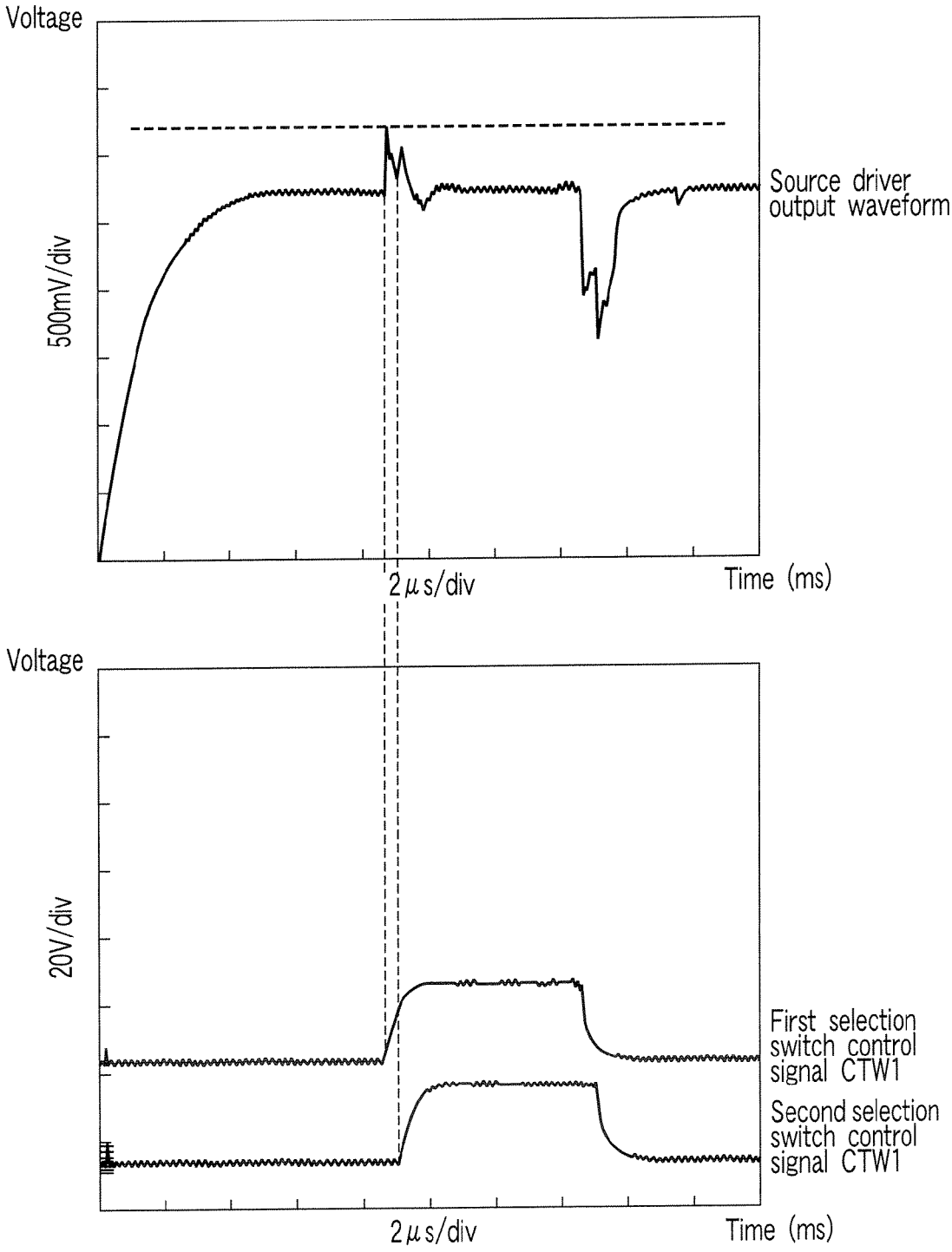
FIG. 4B shows the waveforms in FIG. 4A, with the time axis being enlarged.

If the first selection switch control signal CTW1 and second selection switch control signal CTW2 are turned off at the same time, the load on the source driver DSL becomes smaller than when the source driver DSL is connected to the associated source lines SL. As a result, the output signal of the source driver DSL temporarily increases. In the present embodiment, as shown in FIG. 4A and FIG. 4B, the timing of turn-off of the first selection switch control signal CTW1 is made different from the timing of turn-off of the second selection switch control signal CTW2. Accordingly, the variation in the load on the source driver DSL is dispersed, and the output signal of the source driver DSL is prevented from exceeding the rated voltage.

Therefore, the invention can provide a liquid crystal display device and a driving method thereof, which prevent a voltage signal, which is higher than a rated voltage, from occurring when a plurality of channels for selecting the source line SL are turned off at the same time, and thus prevent an erroneous operation.

The present invention is not limited directly to the above-described embodiment. In practice, the structural elements can be modified without departing from the spirit of the invention.

Various inventions can be made by properly combining the structural elements disclosed in the embodiment. For example, some structural elements may be omitted from all the structural elements disclosed in the embodiment. Furthermore, structural elements in different embodiments may properly be combined.

What is claimed is:

1. A liquid crystal display device comprising:

a plurality of source lines;

a plurality of display pixels, each of which is connected to an associated one of the plurality of source lines;

an output driver which outputs a non-video signal which is common to the plurality of source lines in a non-video signal write period and a video signal, which is independent of the non-video signal, in association with each of the plurality of source lines in a video signal write period;

a selection switch circuit which is connected between the plurality of source lines and the output driver; and a controller which controls the output driver and the selection switch circuit, wherein the non-video signal write period includes a period to provide the non-video signal to the plurality of source lines simultaneously, the controller is configured to control the selection switch circuit such that the non-video signal is supplied to the plurality of source lines in parallel, and a timing of an end of a supply of the non-video signal is varied between the plurality of source lines.

2. The liquid crystal display device according to claim 1, wherein the selection switch circuit includes a plurality of analog switches, each of which is connected to the output driver and an associated one of the plurality of source lines, and the controller includes a delay circuit which selectively delays a switch control signal to the plurality of analog switches such that a timing of the supply of the non-video signal, which is common to the plurality of source lines, is varied between the plurality of source lines.

3. The liquid crystal display device according to claim 1, wherein the plurality of display pixels include an OCB mode liquid crystal layer.

4. The liquid crystal display device according to claim 3, wherein the non-video signal has a voltage level for preventing a reverse transition of liquid crystal molecules.

5. A driving method of a liquid crystal display device including a plurality of source lines; a plurality of display pixels, each of which is connected to an associated one of the plurality of source lines; an output driver which outputs a non-video signal which is common to the plurality of source lines in a non-video signal write period and a video signal, which is independent of the non-video signal, in association with each of the plurality of source lines in a video signal write period; a selection switch circuit which is connected between the plurality of source lines and the output driver; and a controller which controls the output driver and the selection switch circuit, the driving method comprising:

controlling the selection switch circuit by the controller such that the non-video signal is supplied to the plurality of source lines in parallel such that the non-video signal write period includes a period to provide the non-video signal to the plurality of source lines simultaneously, and a timing of an end of a supply of the non-video signal is varied between the plurality of source lines.

6. The driving method of a liquid crystal display device, according to claim 5, wherein the selection switch circuit includes a plurality of analog switches, each of which is connected to the output driver and an associated one of the plurality of source lines, and the controller selectively delays a switch control signal to the plurality of analog switches such that a timing of the supply of the non-video signal, which is common to the plurality of source lines, is varied between the plurality of source lines.

7. The driving method of a liquid crystal display device, according to claim 5, wherein the plurality of display pixels include an OCB mode liquid crystal layer, and the controller sets the non-video signal at a voltage level for preventing a reverse transition of liquid crystal molecules.

* * * * *